US005780191A

United States Patent [19]

Ide

[11] Patent Number: 5,780,191

[45] Date of Patent: Jul. 14, 1998

[54] MULTICOLOR IMAGE FORMING METHOD

[75] Inventor: Osamu Ide, Minami-Ashigara, Japan

[73] Assignee: Fuji Xerox Co., Ltd., Tokyo, Japan

[21] Appl. No.: 780,896

[22] Filed: Jan. 9, 1997

[30] Foreign Application Priority Data

Jan. 18, 1996 [JP] Japan ..... 8-006863

[51] Int. Cl.[6] ..... G03G 13/01

[52] U.S. Cl. ..... 430/45; 430/42; 430/97; 430/126

[58] Field of Search ..... 430/42, 45, 97, 430/126

[56] References Cited

U.S. PATENT DOCUMENTS

| | | | |
|---|---|---|---|
| 5,234,783 | 8/1993 | Ng | 430/45 |
| 5,530,532 | 6/1996 | Iino et al. | 430/126 |
| 5,620,821 | 4/1997 | Ogura | 430/45 |

FOREIGN PATENT DOCUMENTS

| | | |
|---|---|---|
| A-63 58374 | 3/1988 | Japan . |
| A-63 92964 | 4/1988 | Japan . |
| A-63 92965 | 4/1988 | Japan . |
| A-4 204669 | 7/1992 | Japan . |
| A-4 204670 | 7/1992 | Japan . |
| A-4 278967 | 10/1992 | Japan . |
| A-5 232840 | 9/1993 | Japan . |
| A-7 72696 | 3/1995 | Japan . |

*Primary Examiner*—Roland Martin
*Attorney, Agent, or Firm*—Oliff & Berridge, PLC

[57] ABSTRACT

A method of forming a multi-color image is provided with which a high quality image having appropriate glossiness, satisfactory graininess, excellent color tone quality and smooth characteristic, similarly to that obtainable by printing or silver salt photography, can be formed uniformly on a transfer member by an electrophotographic method regardless of the type of the image. A method of forming a multi-color image in which a plurality of color toner layers are fixed onto a transfer member as images, having the step of: fixing a transparent toner layer to at least non-image portions, wherein mean surface roughness (Ra) of a fixed layer is $0.0<Ra<1.5$ μm and/or maximum surface roughness (Rmax) is $0.0<RMax<10$ μm.

16 Claims, 1 Drawing Sheet

MULTICOLOR IMAGE FORMING METHOD

BACKGROUND OF THE INVENTION

1. Field of the Invention

The present invention relates to a method of forming a multi-color image by an electrophotographic method or an electrostatic recording method.

2. Description of the Related Art

Hitherto, a color image has been formed by an electrophotographic method as follows for example: light beams reflected from an original document are separated into color components by a color CCD; and then the color components are subjected to an image process and a color correction process in an image processing apparatus so that plural color image signals are obtained. A photosensitive member (photoreceptor) is irradiated by each of laser beams obtained by modulating the color image signals, for example, by a semiconductor laser unit so that a plurality of electrostatic latent images are formed. The electrostatic latent images are sequentially developed with yellow, magenta, cyan and black toners, and then the toner images are transferred from the photosensitive member to a transfer member, such as paper. Thereafter, the transferred image is heated so as to be fixed by a thermal fixing roll or the like so that a color image is formed.

Granular shapes of the fixed toners remain in the thus-obtained color image. Moreover, the transfer member (for example, paper) has been impregnated with binder resins and coloring materials so that the transfer member itself is roughened. Thus, the surface of the transfer member is roughened irregularly as compared with the surface of an image obtained by printing or silver-salt photography. It leads to a fact that irregular reflection takes places on the surface of the image. Even if highly dispersed pigment or toner having a small particle size is employed, the graininess, surface gloss, image tone and the like are unsatisfactory.

The shape of the toner particles and the influence of the roughness of the transfer member varies with the optical density of the image. The type of the image, whether the image is the background portion, a low density portion or high density portion, causes the gloss, graininess and image tone to be changed. In comparison to an image formed by printing or silver-salt photography, the image obtained by the electrophotographic process is unsatisfactory in the smoothness and naturalness.

The influence of the roughness of the surface of the transfer member is considerably affected by the type of the transfer member. Thus, satisfactory glossiness and graininess cannot be obtained from a low-cost transfer member having a rough surface.

If the quantity of the developer is increased in order to overcome the foregoing problems, no effect is obtained in a non-image portion (the background portion) though the fixed layer is able to prevent the surface roughness of the transfer member from adversely affecting the image thereon and satisfactory glossiness can be obtained in the high density portion. If the quantity of the developer is furthermore increased, the quantity of the electrostatic charge is reduced. Hence, there arises a problem in that the background portion is fogged.

In order to overcome the foregoing problems, methods of transferring and fixing transparent toner in addition to the color toner have been disclosed in JP-A No. 63-58374, JP-A No. 63-92965, JP-A No. 4-278967, JP-A No. 4-204669, JP-A No. 4-204670, JP-A No. 7-72696 and JP-A No. 5-232840. Another method has been disclosed in JP-A No. 63-92964 and JP-A No. 63-92965 in which the transfer member is previously coated with a transparent resin.

However, the foregoing methods have problems in that toner is excessively dissolved by fixing, causing infiltration into the transfer member (for example, paper) to take place. Further, toner cannot sufficiently be dissolved so that the shape of the toner particles remains in the image. That is, the physical roughness of the surface of the image is not controlled. Thus, satisfactory graininess and glossiness cannot be realized because of irregular reflection from the surface of the image. As a result, the expected effect has not been obtained.

SUMMARY OF THE INVENTION

Accordingly, an object of the present invention is to provide a method of forming a multi-color image with which a high quality image having appropriate glossiness, satisfactory graininess, excellent image tone quality and smooth surface characteristic, similarly to that obtainable by printing or silver salt photography, can be formed uniformly on a transfer member by an electrophotographic method regardless of the type of the image.

Inventors of the present invention investigated methods of achieving the foregoing object, and it has been found that a color image obtained by using a color copying machine adapted to an electrophotographic method involves a great difference in the surface roughness as compared with a color image obtained by the silver salt photography or a high-quality printing process. In particular, a considerable difference arises between an image portion and a non-image portion or an intermediate optical density portion. Then, it has been found that, if a transparent toner layer is formed on the non-image portion or both of the non-image portion and the image portion and the surface roughness is controlled to a specific range, the glossiness of the image and the graininess can be improved. Thus, the object of the present invention was achieved.

That is, according to one aspect of the present invention, there is provided a method of forming a multi-color image in which a plurality of color toner layers are fixed onto a transfer member as images, comprising the step of: fixing a transparent toner layer to at least non-image portions, wherein mean surface roughness (Ra) of a fixed layer is $0.0<Ra<1.5$ μm and/or maximum surface roughness (RMax) is $0.0<RMax<10$ μm.

The present invention is structured such that the surface roughness of the overall fixed image is fined to the specific range so that scattering of light on the surface of the image is prevented and therefore the foregoing object is effectively realized.

In the present invention, the transparent toner layer may be formed on image portions formed by color toner layers as well as the non-image portions. In this case, the transparent toner layer may be formed on or beneath the color toner layer. In either case, the fixed layer is able to prevent the surface roughness of the transfer member (for example, paper) from adversely effecting the image thereon so that the surface roughness satisfies the specified range according to the present invention. It is preferable that the transparent toner layer be formed on the color toner layer. In this case, an adverse effect when the color toner layer is formed on the transfer member can be avoided so that insufficient image quality can be prevented.

It is preferable in the present invention that the relation between mean surface roughness (Ra) obtained when an image is fixed in case that a color toner layer and a transparent toner layer are provided, and mean surface roughness (Ra') obtained when the image is fixed in case that the color toner layer is provided and the transparent toner layer is excluded, satisfies 0.0<Ra<0.7Ra', or the relation between maximum surface roughness (RMax) obtained when the image is fixed in case that the color toner layer and the transparent toner layer are provided and maximum surface roughness (RMax') obtained when the image is fixed in case that the color toner layer is provided and the transparent toner layer is excluded, satisfies 0.0<RMax<0.7RMax'.

The process for "an image is fixed in case that the color toner layer is provided and the transparent toner layer is excluded" is merely utilized for defining a reference of the present invention and this process itself is not included in the scope of the present invention. The process is performed by the same method according to the present invention except the transparent toner layer being excluded. Thus, it can be used as a reference for determining a preferred range of the present invention.

DESCRIPTION OF THE PREFERRED EMBODIMENTS

Figure 1:
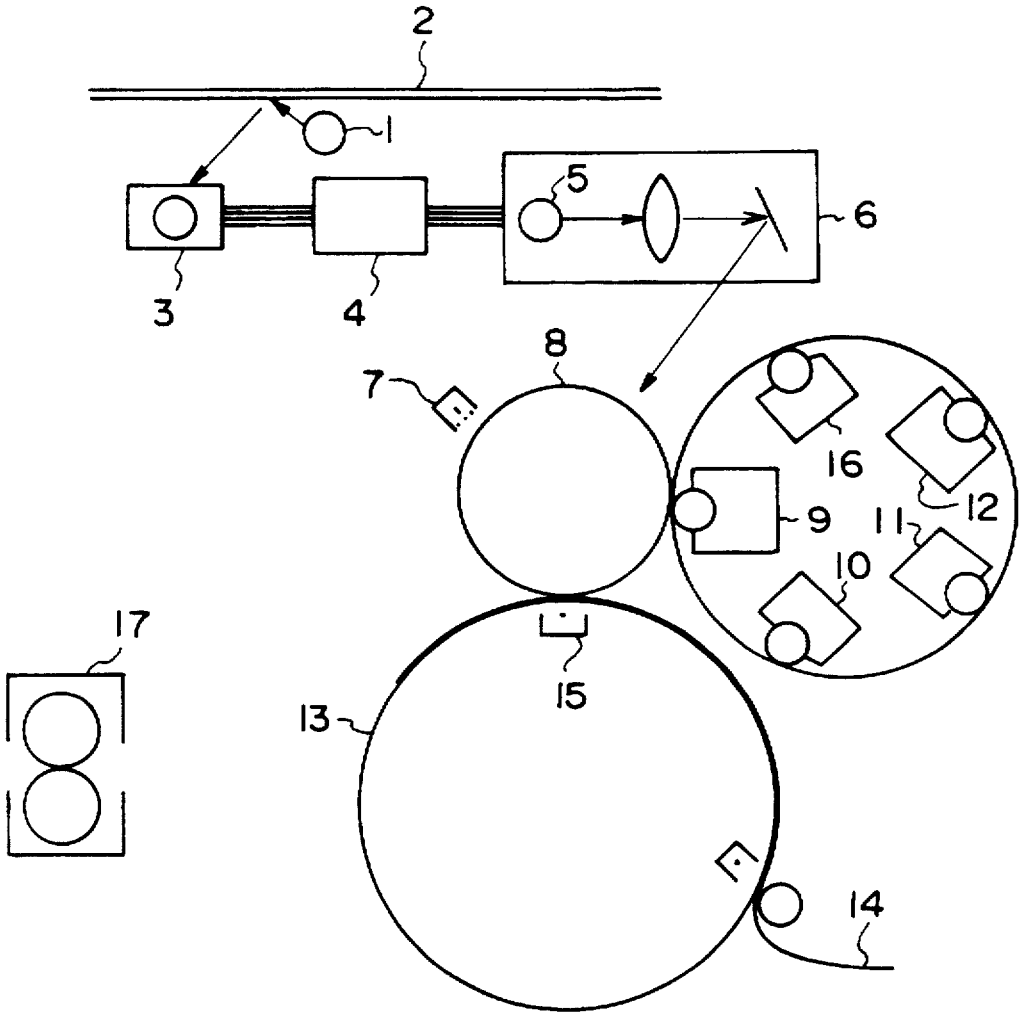
FIG. 1 is a schematic view showing an apparatus for forming a multi-color image for use in an embodiment of the present invention.

Embodiments of the present invention will now be described.

A multi-color image forming method according to the present invention is established by improving a method of fixing a plurality of color toner layers to a transfer member as an image. The fixing method may be an arbitrary method known in the field of the related industry.

The method according to the present invention has the step of fixing a transparent toner layer to at least non-image portions and making 0.0<Ra<1.5 μm and/or 0.0<RMax<10 μm assuming that mean surface roughness is Ra and maximum surface roughness of a fixed layer is RMax in order to improve the graininess and glossiness of the fixed layer (that is, a fixed color toner layer and a fixed transparent toner layer) The following fact has been found: if Ra is larger than 1.5 μm and if RMax is greater than 10 μm, the graininess of the image is deteriorated due to irregular reflection on the surface of the image. As a result, the glossiness and color reproduction deteriorate.

It is preferable for the present invention that the relation between the mean surface roughness Ra when an image is fixed in case that both of a color toner layer and a transparent toner layer are provided, and Ra' when an image is fixed in case that the color toner layer is provided and the transparent toner layer is excluded satisfies 0.0<Ra<0.7Ra'. It is preferable that maximum surface roughness RMax obtained when the image is fixed in case that the color toner layer and the transparent toner layer are provided and maximum surface roughness RMax' obtained when the image is fixed in case that the color toner layer is provided and the transparent toner layer is excluded satisfies 0.0<RMax<0.7RMax'. By covering the roughness of the transfer member with the transparent toner layer, the glossiness can be improved. As a result, the glossiness of white portions can be improved. Thus, a high quality smooth image exhibiting uniform glossiness can be obtained regardless of the optical density of the image.

Although any method may be employed to control the roughness of the surface of a fixed image to a specific range according to the present invention, it is preferable that the following method be employed.

As a method for controlling the roughness of the surface, the thickness T of a transparent toner layer is determined to satisfy 3t>T>0.5t, wherein t is the thickness of the thickest color toner layer of the color toner layers. The foregoing method is able to eliminate a discontinuity of an image at a boundary between a background (non-image portion) and a high density portion. Thus, the surface roughness in the above-mentioned specific range can easily be obtained and therefore irregular reflection at the interface between images can be prevented. As a result, an image having uniform glossiness can be obtained. If T<0.5t, the surface roughness in the specific range cannot easily be obtained and large discontinuity is formed in the boundary of fixed images. Thus, a poor effect of improving the graininess can be obtained. Moreover, the roughness in a white/low-density portion cannot be prevented, thus resulting in only images being obtained which has low glossiness and unsatisfactory graininess. If 3t<T, offset easily takes place during the fixing operation, causing the life of the fixing unit to be shortened.

Another method of controlling the roughness of the surface may be employed in which the viscosity of the resin for forming the transparent toner at the time of performing the fixing operation is changed. Although the specific procedure is not limited, the molecular weight of the resin in the toner is changed. In order to fine the surface roughness, a resin having a small molecular weight may be employed. Another method may be employed in which the quantity of crosslinked portions in the employed resin are changed. In order to fine the surface roughness, a resin containing the crosslinked portion of the resin in a small quantity may be employed. Another method may be employed in which the molecular structure of the employed resin is changed so as to change the viscosity.

It is preferable that the viscosity of the resin for realizing the surface roughness according to the present invention be $10^1$ to $10^4$ Pa·sec when an image is fixed. If the viscosity is lower than $10^1$ Pa·sec, offset easily takes place when the fixing operation is performed by using a fixing roll. If an oven or the like is used to fix an image, the mechanical strength of the fixed image is unsatisfactory though offset can be prevented. Thus, the fixed image can easily be cracked or the image can easily be damaged when the resin layer is bent or rubbed. If the viscosity is higher than $10^4$ Pa·sec, the surface roughness of the fixed image can be enlarged excessively to satisfy the value according to the present invention.

As the resin for forming the transparent toner layer according to the present invention, any one of known polyester resins, polystyrene resins, polyacryl resins, polyolefin resins, polycarbonate resins, polyamide resins, polyimide resins, epoxy resins and polyurea resins may arbitrarily be selected in consideration of required transparency. To obtain required transparency and mechanical strength, it is preferable that the polyester resins be employed. It is preferable that the surface roughness of a fixed image formed by the method according to the present invention be free from irregularity and be uniform. In order to realize this, control of the fluidity and the charging characteristic of the transparent toner is an important factor. To perform the control, inorganic particles and/or resin particles are allowed to adhere to the surface of the transparent toner.

The type of the inorganic particles and the resin particles is not limited if a desired effect can be obtained. The inorganic particles are exemplified by silica, titanium oxide, tin oxide and molybdenum oxide. If stability of the dispersion characteristic is required, any one of the foregoing materials subject to a process to have a hydrophobic characteristic with a silane coupling agent or titanium coupling agent may be employed. The organic particles may be polyester resin, polystyrene resin, polyacryl resin, polyolefin resin, polycarbonate resin, polyamide resin, polyimide resin, epoxy resin, polyurea resin or fluorine resin particles.

It is preferable that the diameter of the inorganic particles and/or resin particles be 0.005 μm to 1 μm. If the particle size is smaller than 0.005 μm, coagulation easily takes place when the particles are allowed to adhere to the surface of the transparent toner and therefore the required effect cannot easily be obtained. If the particle size is larger than 1 μm, the surface roughness of the fixed image cannot easily satisfy the range according to the present invention.

In order to improve the effect of the present invention (specifically, the effect obtainable from smoothing the surface), it is preferable that the refractive index n of the inorganic particles allowed to adhere to the surface of the transparent toner, the refractive index N of a binder resin and the weight ratio W of the inorganic particles to the binder resin satisfy the following relationship:

$$-4 \leqq (n-N) \times W \times 100 \leqq 4$$

If the value of $(n-N)\times W\times 100$ is not in the specified range, light scatters at the interface between the inorganic particles and the binder resin. Although the surface roughness of the image is within the required range in this case, color saturation of the image is reduced and a preferred image cannot be formed.

In order to improve the effect of the present invention intended by smoothing the surface roughness, it is preferable that irregular reflection occurring at the interface between the pigment in the coloring material contained in the toner and the binder be prevented. When a coloring material containing pigment having a small particle size finely dispersed in the binder resin is used under the conditions that the required factors of the present invention satisfy, the above-mentioned object can be achieved. Also combination of use of toner having a small particle size and the required factors of the present invention is able to achieve the above-mentioned object. If the particle size of the toner is larger than 9 μm, the graininess deteriorates excessively because toner particles are visually observed. Thus, the effect obtainable by preventing surface scattering cannot satisfactorily be obtained. If the particle size of the toner is less than 1 μm, toner charged to the reverse polarity increases, causing fogging of the background to take place. As a result, a satisfactory image cannot be obtained.

In light of color reproduction, it is preferable that the surface roughness of the fixed layer be finer than the above-mentioned specified range. For this purpose, it is important to satisfy $0.0<Ra<0.5$ μm. However, if Ra is larger than 0.5 μm, the surface roughness is equivalent to or larger than the wavelength of light. Thus, light scattering takes place on the surface. Since the scattered light beams cannot be absorbed by the image in this case, the optical density of the image decreases.

To achieve the above-mentioned surface roughness, a base material having a surface layer containing at least the binder resin and a surface roughness of 0 μm to 0.7 μm is employed and a non-contact oven or a radiant fixing unit is employed in the process for fixing the transparent toner. In order to achieve a satisfactorily fine surface roughness, it is preferable that the fixing operation is performed for a long time in a state where the viscosity of the toner has been lowered satisfactorily. In order to prevent penetration of the molten toner into the gaps among fibers of the base, it is preferable that a base having a surface layer containing at least the binder resin be employed.

A method of forming the transparent toner layer will now be described. Any method may arbitrarily be employed if the required factors of the present invention can be realized. In consideration of the foregoing description, the following methods may be selected.

As disclosed in JP-A No. 63-58374, the transparent toner previously mixed with a carrier and charged electrically is, similarly to the color toner developing method, supplied into a developing unit so as to be moved adjacent to the photosensitive member so that an electrostatic latent image is formed on the photosensitive member. Thereafter, the latent image is developed by electrostatic force, and then the developed image is transferred to the transfer member on which an image has been developed and transferred with a color toner. Then, the transferred image is heated and fixed by the fixing roll.

Another method may be employed in which the latent image on the photosensitive member is developed with the transparent toner, and then the photosensitive member is again charged electrically and exposed to light so that the image is developed with the color toner. This process is repeated in the number equivalent to the number of the color toners to form a plurality of toner layers on the photosensitive member. Thereafter, the image thus obtained is transferred onto the transfer member at one time and fixed by the fixing roll.

Note that a known toner may be employed in the present invention. The color toner may be manufactured by allowing inorganic particles of, for example, silicon oxide, titanium oxide or aluminum oxide, having a mean particle size of 5 μm to 100 μm or PMMA resin particles or PVDF resin particles to adhere to particles having a mean particle size of 1 μm to 15 μm, preferably 1 μm to 9 μm manufactured by dispersing pigment serving as the coloring material in a binder resin, such as a polyester resin, or a resin of styrene/acryl copolymer or styrene/butadiene copolymer.

Also the coloring pigment may be selected arbitrarily, for example:

Yellow coloring material: Benzidine yellow, Quinoline yellow and Hansa yellow,

Magenta coloring material: Rhodamine B, Rose bengal and Pigment red,

Cyan coloring material: Phthalocyanine blue, Aniline blue and Pigment blue,

Black coloring material: carbon black, Aniline black and blended color pigments.

The surface roughness (Ra and Rmax) according to the present invention is measured by suing a surface roughness meter "Perthometer C5D (Perthen)" such that a needle having a tip diameter of 2 μm is used under conditions that the scanning speed is 0.5 mm/sec, the length to be measured is 1.0 mm, the measuring pitch is 1 μm and the cutting off is 0.8 mm so as to obtain Rai and Rmaxi. Then, regions each having a size of 0.25 mm are measured 50 times at a measuring pitch of 5 μm in a direction perpendicular to the scanning direction. Average values of results are employed as Ra and Rmax. When Rai, Rmaxi and the average value are calculated, an image analyzer SAS-2010 (manufactured by Meishin Koki) is employed.

EXAMPLES

Examples of the present invention will now be described. Evaluation Methods Common to examples below:

The graininess was visually evaluated by using 2 cm×2 cm solid images having different average reflection densities. The evaluation was performed by twenty evaluators such that the results were classified into 1. very rough image, 2. rough image, 3. allowable level, 4. fine image and 5. very fine image, and the average level of the evaluation was obtained. Results in which the average value was lower than 2 were given C, those in which the average value was not lower than 2 and lower than 4 were given B and those in which the average value was not lower than 4 were given A.

The color reproduction was measured by using X-rite 404 (manufactured by X-rite) such that the optical density of an image in a region, in which the density of the magenta image area coverage was 100%, was measured and the evaluation was classified into C when the optical density was lower than 1.4, B when the optical density was not lower than 1.4 and lower than 1.7 and A when the optical density was higher than 1.7.

The visual assessment of the overall image was visually performed by evaluating a portrait. The portrait was evaluated by 20 evaluators into 1. unsatisfactory, 2. not allowable, 3. allowable, 4. good, 5. excellent. Then, the average level was obtained. If the average level was lower than 2, then C was given, if the average level was not lower than 2 and lower than 4, then B was given and if the average level was not lower than 4, then A was given.

The specular gloss was measured by Gloss Meter GM-26D (manufactured by Murakami Color Technology Institute) The incidental angle of light upon the image was 75 degrees.

The viscosity was measured by a rheometer RD-2 (manufactured by Rheometrix) of a rotation plate type such that the temperature, at which the viscosity was measured, was set to the same temperature as that when the toner was actually fixed, so as to obtain the viscosity when the frequency of the dynamic viscosity was 0.1 rad/sec.

The molecular weight was determined by a gelpermission chromatography such that tetrahydrofuran was employed as the solvent.

The average particle size was determined by using Coulter counter and d50 of the average weight was employed.

The average particle size of the particles added to the surface of the toner was measured such that 100 particles were photographed by a reflection type electron microscope to obtain half of the total sum of longer axes and shorter axes of 100 particles so as to use the average value.

Example 1

Cyan, magenta, yellow and black toners for A-color manufactured by Fuji Xerox Co., Ltd. were employed.

Method of Manufacturing Transparent Toner A

Binder Resin: linear polyester (Tg=62 degrees, Mn=4000, Mw=35000) obtained from terephthalic acid/bis phenol A ethylene oxide adduct/cyclohexanedimethanol and having viscosity of $5\times10^2$ Pa·sec and refractive index of 1.5.

The above-mentioned material was pulverized by a jet mill, and then classified by an air classifier so that transparent toner having d50=7 μm was manufactured. Then, the following inorganic particles were allowed to adhere to the surface of the manufactured transparent toner by a high speed mixer.

Inorganic particle A: $SiO_2$ (having the surface subjected to a hydrophobic treatment with a silane coupling agent), having a mean particle size of 0.05 μm and a refractive index of 1.6, and contained by 1.1 parts by weight.

Inorganic particle B: $TiO_2$ (having the surface subjected to a hydrophobic treatment with a silane coupling agent), having a mean particle size of 0.02 μm and a refractive index of 2.5, and contained by 1.4 parts by weight.

Method of Manufacturing Developer

Spherical ferrite particles having a particle size of about 50 μm coated with stylene methylmethacrylate copolymer was employed as a carrier. Each of the color toner and the transparent toner was added by 8 parts by weight with respect to 100 parts by weight of the above-mentioned carrier. Then, a tumbler shaker mixer was used to mix the materials so that two-component developer was obtained.

Method of Forming Image

In this example, an apparatus manufactured by modifying A-color 630, which was a color copying machine manufactured by Fuji Xerox, and structured as schematically shown in FIG. 1 was employed. In the above-mentioned apparatus, light emitted from a light source 1 and reflected by an original document 2 was read by a color CCD 3, and then separated into yellow, magenta and cyan components by an image processing apparatus 4. The obtained color components were, as signals subjected to an image process, sequentially transmitted from a semiconductor laser unit 5 as optical signals. The optical signals were allowed to pass through an optical system 6 so as to be used to irradiate a photosensitive member 8 previously charged by a charger 7. Thus, an electrostatic latent image in which image portions have low potentials was formed. The developers for the charged color toners obtained by the foregoing method were supplied to developing units 9 to 12 to which developing biases were applied. Thus, the color toners were developed on a photosensitive member by the electrostatic force. Each of the developed toners was, with electric fields supplied from a transfer corotron 15, sequentially transferred to a base 14 electrostatically adsorbed to a transfer drum 13. The above-mentioned process was repeated three times for yellow, magenta and cyan so that a superposed color toner image on the transfer member was obtained. Then, a charged developer obtained by mixing the above-described transparent toner and the carrier was accommodated in a developing unit 16, and a developing bias was applied thereto so that the surface of the photosensitive material, the overall surface of which has been exposed to light, was uniformly developed by the transparent toner with electrostatic force. The developed solid image thus obtained was, with electrostatic force, transferred to the surface of the color toner image which has been formed on the transfer member and then heated and fixed by a fixing unit 17 so that a color image was obtained. The toner was heated to 120° C. when fixed. The base for use in the measurement was sheets for color (trade name: paper J) manufactured by Fuji Xerox.

The weight of the developed color toner was 0.72 mg/cm$^2$ in the portions of images having the highest density and the weight of the developed transparent toner was 0.75 mg/cm

Example 2

A color image was formed similarly to Example 1 except the binder resin for the transparent toner being changed as follows:

Binder Resin: linear polyester (Tg=65 degrees, Mn=8000, Mw=50000) obtained from terephthalic acid/bis phenol A ethylene oxide adduct/cyclohexanedimethanol and having viscosity of $5\times10^3$ Pa·sec and refractive index of 1.5.

Example 3

A color image was formed similarly to Example 1 except the particles allowed to adhere to the surface of the transparent toner was changed to the following material and the weight being changed to 1.5 parts by weight:

Particles Allowed to Adhere to Surface: Polymethyl methacrylate having a particle size of 0.8 μm and a refractive index of 1.4.

Example 4

A color image was formed similarly to Example 1 except the base for forming the image being changed to an art sheet for printing "Kanefuji" (manufactured by Shin-Oji Paper Mill Co. having Ra 0.3 μm) and the process for fixing the transparent toner being changed to a procedure in which the transparent toner was placed in an oven set to 170° for 10 seconds.

Example 5

A color image was formed similarly to Example 1 except the quantity of the inorganic particles B allowed to adhere to the surface of the transparent toner being changed to 5 parts by weight.

Example 6

A color image was formed similarly to Example 1 except the magenta toner among the color toners being manufactured as described later. The dispersed state of the coloring material using the manufactured magenta toner was observed with a transmission type electron microscope, thus resulting in a multiplicity of coagulated coloring materials having sizes of about 1 μm to about 3 μm being observed.

Binder Resin: linear polyester (Tg=62 degrees, Mn=4000, Mw=35000) obtained from terephthalic acid/bis phenol A ethylene oxide adduct/cyclohexanedimethanol and having viscosity of $5\times10^2$ Pa·sec and refractive index of 1.5.

Coloring Material: same as coloring materials for A-color except the coloring material in this case has not been processed.

The foregoing materials were kneaded by an extruder, and then pulverized by a jet mill. Then, the materials were classified by an air classifier so that transparent toner having $d_{50}$=7 μm was manufactured. Then, the following inorganic particles were allowed to adhere to the surface of the manufactured transparent toner by a high speed mixer.

Inorganic particle A: $SiO_2$ (having the surface subjected to a hydrophobic treatment with a silane coupling agent), having a mean particle size of 0.05 μm and a refractive index of 1.6, and contained by 1.1 parts by weight.

Inorganic particle B: $TiO_2$ (having the surface subjected to a hydrophobic treatment with a silane coupling agent), having a mean particle size of 0.02 μm and a refractive index of 2.5, and contained by 1.4 parts by weight.

Example 7

A color image was formed similarly to Example 1 except the mean particle size of the color toner being made to be 11 μm.

Comparative Example 1

A color image was formed by using the color toner and carrier according to Example 1 without any transparent toner by an apparatus according to Example 1.

Comparative Example 2

A color image was formed similarly to Example 1 except that the weight of the developed color toner was 0.72 mg/cm$^2$ in the portions of images having the highest optical density and the weight of the developed transparent toner was 0.3 mg/cm$^2$.

Comparative Example 3

A color image was formed similarly to Example 1 except the binder resin for the transparent toner being changed as follows:

Binder resin: linear polyester (Tg=70 degrees, Mn=10000, Mw=60000) obtained from terephthalic acid/bisphenol A ethylene oxide adduct/cyclohexanedimethanol and having viscosity of $5\times10^4$ Pa·sec and refractive index of 1.5.

Comparative Example 4

A color image was formed similarly to Example 1 except that no inorganic particles were allowed to adhere to the surface of the transparent toner.

Comparative Example 5

A color image was formed similarly to Example 1 except the particles allowed to adhere to the surface of the transparent toner being changed as follows;

Particles Allowed to Adhere to Surface: polymethyl methacrylate having a particle size of 1.2 μm, a refractive index of 1.4 in a quantity of 2.0 parts by weight.

Comparative Example 6

A color image was formed similarly to Example 1 except the process for fixing the transparent toner being changed to a process in which the same was placed in an oven set to 170° C. for 10 seconds.

Results of the evaluation of the images obtained in Examples 1 to 7 are shown in Table 1. On the other hand, results of the evaluation of the images obtained in Comparative Examples 1 to 6 are shown in Table 2.

TABLE 1

Results of Evaluation of Examples

| | Ra (μm) | Rmax (μm) | Ra/Ra' | Rmax/Rmax' | Graininess | Surface Gloss | Color Reproduction | Visual Assessment |
|---|---|---|---|---|---|---|---|---|
| Example 1 | | | | | | | | |
| H.D.I. | 0.67 | 5.28 | 1.26 | 1.43 | B | 55 | A | A |
| L.D.I. | 0.91 | 6.95 | 0.50 | 0.51 | A | 53 | | |
| W.B.K. | 0.87 | 6.31 | 0.57 | 0.56 | A | 53 | | |

TABLE 1-continued

Results of Evaluation of Examples

| | Ra (μm) | Rmax (μm) | Ra/Ra' | Rmax/ Rmax' | Graini-ness | Surface Gloss | Color Repro-duction | Visual Assess-ment |
|---|---|---|---|---|---|---|---|---|
| Example 2 | | | | | | | | |
| H.D.I. | 1.10 | 8.81 | 2.10 | 2.4 | A | 43 | B | A |
| L.D.I. | 1.25 | 9.15 | 0.69 | 0.55 | B | 41 | | |
| W.B.K. | 1.05 | 8.62 | 0.69 | 0.77 | A | 40 | | |
| Example 3 | | | | | | | | |
| H.D.I. | 0.88 | 6.70 | 1.30 | 1.81 | A | 48 | B | A |
| L.D.I. | 0.95 | 7.10 | 0.51 | 0.52 | B | 45 | | |
| W.B.K. | 0.97 | 8.05 | 0.60 | 0.72 | A | 45 | | |
| Example 4 | | | | | | | | |
| H.D.I. | 0.30 | 2.11 | 0.67 | 0.65 | A | 92 | A | A |
| L.D.I. | 0.31 | 2.07 | 0.30 | 0.29 | A | 89 | | |
| W.B.K. | 0.30 | 2.20 | 0.67 | 0.68 | A | 91 | | |
| Example 5 | | | | | | | | |
| H.D.I. | 0.66 | 5.51 | 1.25 | 1.45 | A | 58 | B | B |
| L.D.I. | 0.85 | 6.52 | 0.47 | 0.48 | B | 50 | | |
| W.B.K. | 0.79 | 5.99 | 0.52 | 0.51 | A | 52 | | |
| Example 6 | | | | | | | | |
| H.D.I. | 0.70 | 5.67 | 1.28 | 1.53 | B | 55 | B | B |
| L.D.I. | 0.77 | 5.87 | 0.42 | 0.43 | B | 52 | | |
| W.B.K. | 0.81 | 6.14 | 0.53 | 0.65 | A | 50 | | |
| Example 7 | | | | | | | | |
| H.D.I. | 0.65 | 5.47 | 1.22 | 1.48 | B | 58 | A | B |
| L.D.I. | 0.71 | 5.81 | 0.39 | 0.43 | B | 52 | | |
| W.B.K. | 0.78 | 6.02 | 0.51 | 0.54 | A | 49 | | |

Remarks:
H.D.I., L.D.I. and W.D.K. stand for high density image, low density image and white background, respectively.
A, B and C denote "excellent", "acceptable" and "not acceptable", respectively.

TABLE 2

Results of Evaluation of Comparative Examples

| | Ra (μm) | Rmax (μm) | Ra/Ra' | Rmax/ Rmax' | Graini-ness | Surface Gloss | Color Repro-duction | Visual Assess-ment |
|---|---|---|---|---|---|---|---|---|
| Example 1 | | | | | | | | |
| H.D.I. | 0.53 | 3.69 | 1.0 | 1.0 | A | 74 | A | B |
| L.D.I. | 1.81 | 13.51 | 1.0 | 1.0 | C | 29 | | |
| W.B.K. | 1.52 | 11.12 | 1.0 | 1.0 | A | 10 | | |
| Example 2 | | | | | | | | |
| H.D.I. | 0.61 | 5.10 | 1.2 | 1.38 | A | 61 | A | B |
| L.D.I. | 1.67 | 12.14 | 0.92 | 0.90 | C | 31 | | |
| W.B.K. | 1.48 | 10.45 | 0.97 | 0.94 | A | 17 | | |
| Example 3 | | | | | | | | |
| H.D.I. | 1.45 | 10.11 | 2.73 | 2.74 | A | 22 | C | B |
| L.D.I. | 1.67 | 11.95 | 0.92 | 0.88 | A | 18 | | |
| W.B.K. | 1.71 | 12.57 | 1.12 | 1.13 | A | 15 | | |
| Example 4 | | | | | | | | |
| H.D.I. | 0.74 | 7.81 | 1.39 | 2.11 | C | 56 | C | C |
| L.D.I. | 1.58 | 14.61 | 0.87 | 1.08 | C | 41 | | |
| W.B.K. | 1.62 | 15.21 | 1.07 | 1.36 | B | 27 | | |

TABLE 2-continued

Results of Evaluation of Comparative Examples

| | Ra (μm) | Rmax (μm) | Ra/Ra' | Rmax/ Rmax' | Graini-ness | Surface Gloss | Color Repro-duction | Visual Assess-ment |
|---|---|---|---|---|---|---|---|---|
| Example 5 | | | | | | | | |
| H.D.I. | 1.57 | 10.71 | 2.98 | 2.90 | A | 28 | C | B |
| L.D.I. | 1.53 | 10.78 | 0.85 | 0.80 | A | 27 | | |
| W.B.K. | 1.64 | 11.51 | 1.08 | 1.04 | A | 18 | | |
| Example 6 | | | | | | | | |
| H.D.I. | 1.30 | 8.91 | 2.45 | 2.41 | C | 35 | C | C |
| L.D.I. | 1.62 | 11.01 | 0.89 | 0.81 | C | 22 | | |
| W.B.K. | 1.61 | 10.88 | 1.06 | 0.97 | B | 18 | | |

Remarks:
H.D.I., L.D.I. and W.D.K. stand for high density image, low density image and white background, respectively.
A, B and C denote "excellent", "acceptable" and "not acceptable", respectively.

Evaluation

Samples according to the examples of the present invention having the transparent toner layer and the portions respectively having the high density and low density and white background portions (non-image portions) satisfying the surface roughness according to the present invention resulted in excellent graininess, surface gloss, color reproduction and the visual assessment. However, the samples according to the comparative examples which did not satisfy the surface roughness according to the present invention resulted in being unsatisfactory at least one of the evaluation items.

As described above, the present invention is able to prevent light scattering at the image surface in the electrophotographic method. As a result, a smooth multi-color image exhibiting an excellent quality having satisfactory graininess and high quality tone can be formed uniformly on a transfer member regardless of the type of the image.

What is claimed is:

1. A method of forming fixed layers of a multi-color image having an image portion and a non-image portion and in which a plurality of color toner layers are fixed onto a transfer member to form the image portion, the method comprising the steps of:

forming a transparent toner layer on the entire surface of a photosensitive member;

forming a plurality of color toner layers on the transparent toner layer;

transferring the plurality of color toner layers and the transfer toner layer onto the transfer member; and fixing the plurality of color toner layers and the transparent toner layer simultaneously to form the multi-color image, wherein a mean surface roughness (Ra) of the fixed layers is $0.0<Ra<1.5$ μm and a maximum surface roughness (RMax) of the fixed layers is $0.0<RMax<10$ μm, and wherein a relation between the mean surface roughness (Ra) obtained when said image is fixed in a case in which said color toner layers and said transparent toner layer are provided and a mean surface roughness (Ra') obtained when said image is fixed in a case in which said color toner layers are provided and said transparent toner layer is excluded satisfies $0.0<Ra<0.7Ra'$.

2. A method of forming fixed layers of a multi-color image having an image portion and a non-image portion and in which a plurality of color toner layers are fixed onto a transfer member to form the image portion, the method comprising the steps of:

forming color toner layers on the surface of a photosensitive member in sequence;

transferring sequentially each of the color toner layers onto the transfer member after each of the color toner layers has been formed;

forming a transparent toner layer on the entire surface of the photosensitive member;

transferring the transparent toner layer onto the color toner layers transferred onto the transfer member; and fixing the color toner layers and the transparent toner layer simultaneously to form the multi-color image, wherein a mean surface roughness (Ra) of the fixed layers is $0.0<Ra<1.5$ μm and a maximum surface roughness (RMax) of the fixed layers is $0.0<Rmax<10$ μm, and wherein a relation between the mean surface roughness (Ra) obtained when said image is fixed in a case in which said color toner layers and said transparent toner layer are provided and a mean surface roughness (Ra') obtained when said image is fixed in a case in which said color toner layers are provided and said transparent toner layer is excluded satisfies $0.0<Ra<0.7Ra'$.

3. A method of forming fixed layers of a multi-color image having an image portion and a non-image portion and in which a plurality of color toner layers are fixed onto a transfer member to form the image portion, the method comprising the steps of:

forming a transparent toner layer on the entire surface of a photosensitive member;

forming a plurality of color toner layers on the transparent toner layer;

transferring the plurality of color toner layers and the transparent toner layer onto the transfer member; and fixing the plurality of color toner layers and the transparent toner layer simultaneously to form the multi-color image, wherein a mean surface roughness (Ra) of the fixed layers is $0.0<Ra<1.5$ μm and a maximum surface roughness (Rmax) of the fixed layers is $0.0<Rmax<10$ μm, and wherein a relation between the mean surface roughness (Rmax) obtained when said image is fixed in a case in which said color toner layers and said transparent toner layer are provided and a mean surface roughness (Rmax') obtained when said image is fixed in a case in which said color toner layers are provided and said transparent toner layer is excluded satisfies 0.0<Rmax<0.7Rmax'.

4. A method of forming fixed layers of a multi-color image having an image portion and a non-image portion and in which a plurality of color toner layers are fixed onto a transfer member to form the image portion, the method comprising the steps of:

forming color toner layers on the surface of a photosensitive member in sequence;

transferring sequentially each of the color toner layers onto the transfer member after each of the color toner layers has been formed;

forming a transparent toner layer on the entire surface of the photosensitive member;

transferring the transparent toner layer onto the transfer member; and fixing the color toner layers and the transparent toner layer simultaneously, wherein a mean surface roughness (Ra) of the fixed layers is 0.0<Ra<1.5 μm and a maximum surface roughness (Rmax) of the fixed layers is 0.0<Rmax<10 μm, and wherein a relation between the mean surface roughness (Rmax) obtained when said image is fixed in a case in which said color toner layers and said transparent toner layer are provided and a mean surface roughness (Rmax') obtained when said image is fixed in a case in which said color toner layers are provided and said transparent toner layer is excluded satisfies 0.0<Rmax<0.7Rmax'.

5. A method of forming a multi-color image according to claim 1, wherein the viscosity of a resin for forming said transparent toner layer is made to satisfy $10^1$ Pa·sec to $10^4$ Pa sec when a fixing operation is performed so that said mean surface roughness (Ra) and said maximum surface roughness (RMax) are maintained in said range.

6. A method of forming a multi-color image according to claim 1, wherein the molecular weight of a resin for forming said transparent toner layer is changed so that said mean surface roughness (Ra) and said maximum surface roughness (RMax) are maintained in said range.

7. A method of forming a multi-color image according to claim 3, wherein thickness T of said transparent toner layer with respect to thickest toner layer t of said color toner layers satisfies 3t>T>0.5t so that said mean surface roughness (Ra) and said maximum surface roughness (RMax) are maintained in said range.

8. A method of forming a multi-color image according to claim 1, thickness T of said transparent toner layer with respect to thickest toner layer t satisfies 3t>T>0.5t so that said mean surface roughness (Ra) and said maximum surface roughness (RMax) are maintained in said range.

9. A method of forming a multi-color image according to claim 5, wherein the resin for forming said transparent toner layer is at least one type of resin selected from the group consisting of polyester resins, polystyrene resins, polyacryl resins, polyolefin resins, polycarbonate resins, polyamide resins, polyimide resins, epoxy resins and polyurea resins.

10. A method of forming a multi-color image according to claim 9, wherein the resin for forming said transparent toner layer contains particles of inorganic fine particles selected from the group consisting of silica, titanium oxide, tin oxide and molybdenum oxide particles, organic fine particles selected from the group consisting of polyester, polystyrene, polyacryl, polyolefin, polycarbonate, polyamide, polyimide, epoxy, polyurea and fluorine resin particles or mixtures thereof.

11. A method of forming a multi-color image according to claim 10, wherein the particles are inorganic fine particles adhered to the surface of the transparent toner, and wherein the refractive index n of the inorganic fine particles, the refractive index N of the resin of the transparent toner and the weight ratio W of the inorganic fine particles to the resin satisfy the relationship $-4<(n-N)\times W\times 100\leqq 4$.

12. A method of forming a multi-color image according to claim 3, wherein the viscosity of a resin for forming said transparent toner layer is made to satisfy $10^1$ Pa·sec to $10^4$ Pa·sec when a fixing operation is performed so that said mean surface roughness (Ra) and said maximum surface roughness (RMax) are maintained in said range.

13. A method of forming a multi-color image according to claim 3, wherein the molecular weight of a resin for forming said transparent toner layer is changed so that said mean surface roughness (Ra) and said maximum surface roughness (RMax) are maintained in said range.

14. A method of forming a multi-color image according to claim 12, wherein the resin for forming said transparent toner layer is at least one type of resin selected from the group consisting of polyester resins, polystyrene resins, polyacryl resins, polyolefin resins, polycarbonate resins, polyamide resins, polyimide resins, epoxy resins and polyurea resins.

15. A method of forming a multi-color image according to claim 14, wherein the particles are inorganic fine particles adhered to the surface of the transparent toner, and wherein the refractive index n of the inorganic fine particles, the refractive index N of the resin and the weight ratio W of the inorganic fine particles to the resin satisfy the relationship $-4<(n-N)\times W\times 100\leqq 4$.

16. A method of forming a multi-color image according to claim 14, wherein the resin for forming said transparent toner layer contains particles of inorganic fine particles selected from the group consisting silica, titanium oxide, tin oxide and molybdenum oxide particles, organic fine particles selected from the group consisting of polyester, polystyrene, polyacryl, polyolefin, polycarbonate, polyamide, polyimide, epoxy, polyurea and fluorine resin particles, or mixtures thereof.

* * * * *